US010428568B2

(12) United States Patent
Brunnmayr

(10) Patent No.: US 10,428,568 B2
(45) Date of Patent: Oct. 1, 2019

(54) ACTUATING DRIVE FOR DRIVING A MOVABLY MOUNTED FURNITURE PART

(71) Applicant: Julius Blum GmbH, Hoechst (AT)

(72) Inventor: Harald Brunnmayr, Hoerbranz (AT)

(73) Assignee: JULIUS BLUM GMBH, Hoechst (AT)

( * ) Notice: Subject to any disclaimer, the term of this patent is extended or adjusted under 35 U.S.C. 154(b) by 0 days.

(21) Appl. No.: 16/126,690

(22) Filed: Sep. 10, 2018

(65) Prior Publication Data

US 2019/0003229 A1 Jan. 3, 2019

Related U.S. Application Data

(63) Continuation of application No. PCT/AT2017/060062, filed on Mar. 10, 2017.

(30) Foreign Application Priority Data

Mar. 11, 2016 (AT) ..... 50207/2016

(51) Int. Cl.
*E05F 1/10* (2006.01)
*E05F 1/12* (2006.01)
(Continued)

(52) U.S. Cl.
CPC ..... *E05F 1/105* (2013.01); *E05F 1/1246* (2013.01); *E05F 3/106* (2013.01); *E05F 5/027* (2013.01);
(Continued)

(58) Field of Classification Search
CPC ..... E05F 1/105; E05F 5/027; E05F 1/1246; E05F 3/106; E05F 5/10; E05F 5/006;
(Continued)

(56) References Cited

U.S. PATENT DOCUMENTS 7,478,891 B2 1/2009 Hollenstein
9,464,473 B2 * 10/2016 Baldreich ..... E05F 1/1058
(Continued)

FOREIGN PATENT DOCUMENTS

DE 20 2006 003 196 8/2007
EP 1 818 491 8/2007
(Continued)

OTHER PUBLICATIONS

International Search Report dated Jun. 16, 2017 in International (PCT) Application No. PCT/AT2017/060062.
(Continued)

*Primary Examiner* — Hiwot E Tefera
(74) *Attorney, Agent, or Firm* — Wenderoth, Lind & Ponack, L.L.P.

(57) ABSTRACT

An actuating drive for driving a movably mounted furniture part includes an actuating arm connected to the furniture part. The actuating arm is configured to be movable between a first end position and a second end position, and a damper is provided for damping a movement of the actuating arm into the first end position and a movement of the actuating arm into the second end position. The damper performs a damping stroke during the damping, and a coupling mechanism is provided for coupling the actuating arm or an actuating part connectable thereto to the damper when the actuating arm is moved into the two end positions. The coupling mechanism has an actuator for performing the damping stroke of the damper, and the actuator acts on the damper when the actuating arm is moved into the first end position and when the actuating arm is moved into the second end position.

20 Claims, 9 Drawing Sheets

(51) Int. Cl.

| | |
|---|---|
| ***E05F 3/10*** | (2006.01) |
| ***E05F 5/02*** | (2006.01) |
| *E05D 15/26* | (2006.01) |
| *E05D 15/46* | (2006.01) |

(52) U.S. Cl.
CPC ..... *E05D 15/262* (2013.01); *E05D 15/463* (2013.01); *E05Y 2201/256* (2013.01); *E05Y 2900/20* (2013.01)

(58) Field of Classification Search
CPC E05F 1/14; E05F 15/60; E05F 1/1058; E05Y 2201/256; E05Y 2900/20; E05Y 2800/73; E05Y 2201/424; E05Y 2201/412; E05Y 2201/62; E05Y 2201/624; E05Y 2201/708; E05Y 2201/474; E05Y 2201/604; E05D 15/262; E05D 15/463; E05D 3/06; E05D 3/16; E05D 3/142; E05D 5/0276; E05D 7/00; E05D 11/1021; E05D 15/264; Y10T 16/5409; Y10T 16/5383
USPC ..... 312/319.1–319.6
See application file for complete search history.

(56) References Cited

U.S. PATENT DOCUMENTS

| | | | | |
|---|---|---|---|---|
| 9,719,283 | B2 * | 8/2017 | Holzapfel | E05F 1/1058 |
| 9,739,081 | B2 | 8/2017 | Stuke | |
| 2006/0174444 | A1 * | 8/2006 | Giovannetti | E05D 15/262 16/354 |
| 2006/0284530 | A1 * | 12/2006 | Hollenstein | E05F 1/1058 312/327 |
| 2008/0121490 | A1 * | 5/2008 | Dubach | E05F 1/1058 192/17 D |
| 2011/0197639 | A1 * | 8/2011 | Hauer | E05D 15/262 70/174 |
| 2012/0049709 | A1 * | 3/2012 | Scheffknecht | E05D 15/262 312/319.6 |
| 2012/0084944 | A1 * | 4/2012 | Hirtsiefer | E05D 3/14 16/302 |
| 2012/0161598 | A1 * | 6/2012 | Blum | E05F 1/1276 312/319.2 |
| 2013/0019713 | A1 * | 1/2013 | Krudener | E05D 3/16 74/99 R |
| 2013/0031746 | A1 * | 2/2013 | Hasegawa | E05D 3/14 16/50 |
| 2013/0154461 | A1 * | 6/2013 | Bohle | A47B 88/457 312/319.6 |
| 2015/0361709 | A1 * | 12/2015 | Stuke | E05D 3/16 16/352 |
| 2015/0377269 | A1 * | 12/2015 | Haemmerle | F16B 12/14 248/122.1 |
| 2016/0376823 | A1 * | 12/2016 | Huber | E05F 1/1058 312/319.2 |
| 2017/0204645 | A1 * | 7/2017 | Lubetz | E05F 1/1058 |
| 2017/0335611 | A1 * | 11/2017 | Brunnmayr | E05D 15/262 |
| 2018/0363346 | A1 * | 12/2018 | Holzapfel | E05F 1/1058 |

FOREIGN PATENT DOCUMENTS

| | | |
|---|---|---|
| EP | 2 093 361 | 8/2009 |
| WO | 2005/075778 | 8/2005 |
| WO | 2014/118320 | 8/2014 |

OTHER PUBLICATIONS

Search Report issued Jan. 2, 2017 in Austrian Application No. A 50207/2016, with English translation.

* cited by examiner

ACTUATING DRIVE FOR DRIVING A MOVABLY MOUNTED FURNITURE PART

BACKGROUND OF THE INVENTION

The invention relates to an actuating drive for driving a movably mounted furniture part, comprising at least one actuating arm for connecting to the furniture part. The at least one actuating arm is implemented to be moveable between a first and a second end position, a damper damps both a movement of the at least one actuating arm into the first end position and a movement of the at least one actuating arm into the second end position, and the damper carries out a damping stroke during damping. A coupling mechanism couples the at least one actuating arm or a actuating part that is or can be connected to the actuating arm to the damper at least during the movements of the at least one actuating arm into the two end positions, and the coupling mechanism has an actuator to carry out the damping stroke of the damper. The invention further relates to furniture with a furniture body and at least one furniture part that mounted movably, preferably about a horizontal axis, preferably in the form of a flap, and at least one actuating drive arranged on a furniture body according to the invention, and the at least one actuating arm of the actuating drive is connected to the at least one furniture part.

An actuating drive is known from WO 2005/075778 A1. In this solution, a damper is mounted in a floating manner on the housing of the actuating drive and is acted on by a complex lever mechanism to carry out the damping stroke. This embodiment requires a considerable amount of space. The lever mechanism to act on the damper is also susceptible to wear and is expensive because of its complexity.

The objective technical object of the present invention is therefore to provide an actuating drive which does not have the disadvantages of the prior art mentioned and is characterised in particular by a compact construction. A further object of the invention is to provide furniture with an actuating drive of this kind.

SUMMARY OF THE INVENTION

According to the invention, the actuating drive for the actuator can act on the damper both when the at least one actuating arm moves into the first end position and when the at least one actuating arm moves into the second end position to carry out the damping stroke. The fact that the damper is therefore always acted on to carry out the damping stroke, i.e. both when the at least one actuating arm moves into the first end position and when the at least one actuating arm moves into the second end position, by the same actuator means, there is no need for an force conversion mechanism that takes up space.

The damping of the movement of the at least one actuating arm by the damper preferably takes place in each case within the ranges which are immediately upstream of the two end positions.

According to a preferred embodiment of the invention, the actuating drive can have an end position force storage for the application of force to the at least one actuating arm both when the at least one actuating arm moves into the first end position and when the at least one actuating arm moves into the second end position. The simultaneous existence of a damper and an end position force store means a damped, driven movement of the at least one actuating position can be carried out regardless of any additional main drive force stores for the application of force to the at least one actuating arm or to compensate for the weight of a furniture part that is movably mounted and connected to the at least one actuating arm. The holding force of the furniture part is in this case not dependent on the design of a main drive force store of this type or the design of a translation mechanism arranged between a main drive force store of this type and the at least one actuating arm.

In combination with the end position force store described, it is possible for the coupling mechanism to advantageously have a preferably pivotably mounted force transmission element, wherein the end position force store acts on the force transmission element both when the at least one actuating arm moves into the first end position and when the at least one actuating arm moves into the second end position.

A force transmission element of this type can also be used to ensure that when it is charged, the end position force store is releasably lockable by the force transmission element and a swiveling lever can move relative to the force transmission element and can engage with the force transmission element in a force-locking or form-locking manner, or vice versa. In the releasably locked and charged condition, the end position force store is then in a waiting position to emit the force stored in the end position force store for a movement of the at least one actuating arm into the first end position or into the second end position.

It is more economically advantageous if the charging of the end position force store is carried out both when the at least one actuating arm moves from the first end position and when the at least one actuating arm moves from the second end position.

A particularly compact construction of the actuating drive is possible if the damper and the end position force store are arranged essentially parallel to one another.

In a particularly simple manner, the coupling of the at least one actuating arm or an actuating part that is or can be connected to the actuating arm to the damper or the end position force store in the event that the at least one actuating arm carries out the movement into the first end position of a first swiveling movement and the movement into the second end position of a second swivel movement which is opposite to the first swivel movement, such that the coupling mechanism has a swiveling lever and a rectification mechanism to convert the two swivel movements of the at least one actuating arm into a swivel movement of the swivel lever occurring in the same direction. Specifically, this rectification mechanism can be achieved by the rectification mechanism having at least one first and one second control curve and at least one first and one second control element. The two control elements are coupled to the at least one actuating arm during movement, the first control element is engaged in the first control curve in the first end position of the at least one actuating arm, and the second control element is engaged in the second control curve in the second end position of the at least one actuating arm. Preferably, the two control curves are arranged on the swiveling lever, and/or the two control elements are arranged on an actuating part that is or can be connected to the at least one actuating arm.

As mentioned at the outset, furniture can have a furniture body and at least one furniture part which is mounted moveably, preferably about a horizontal axis, preferably in the form of a flap. At least one actuating drive according to the invention is arranged on the furniture body, and the at least one actuating arm of the actuating drive is connected to the at least one furniture part.

BRIEF DESCRIPTION OF THE DRAWINGS

Further individual details and advantages of the present invention are described in greater detail below using the description of the figures with reference to the following drawings, in which.

DETAILED DESCRIPTION OF THE INVENTION

Figure 1:
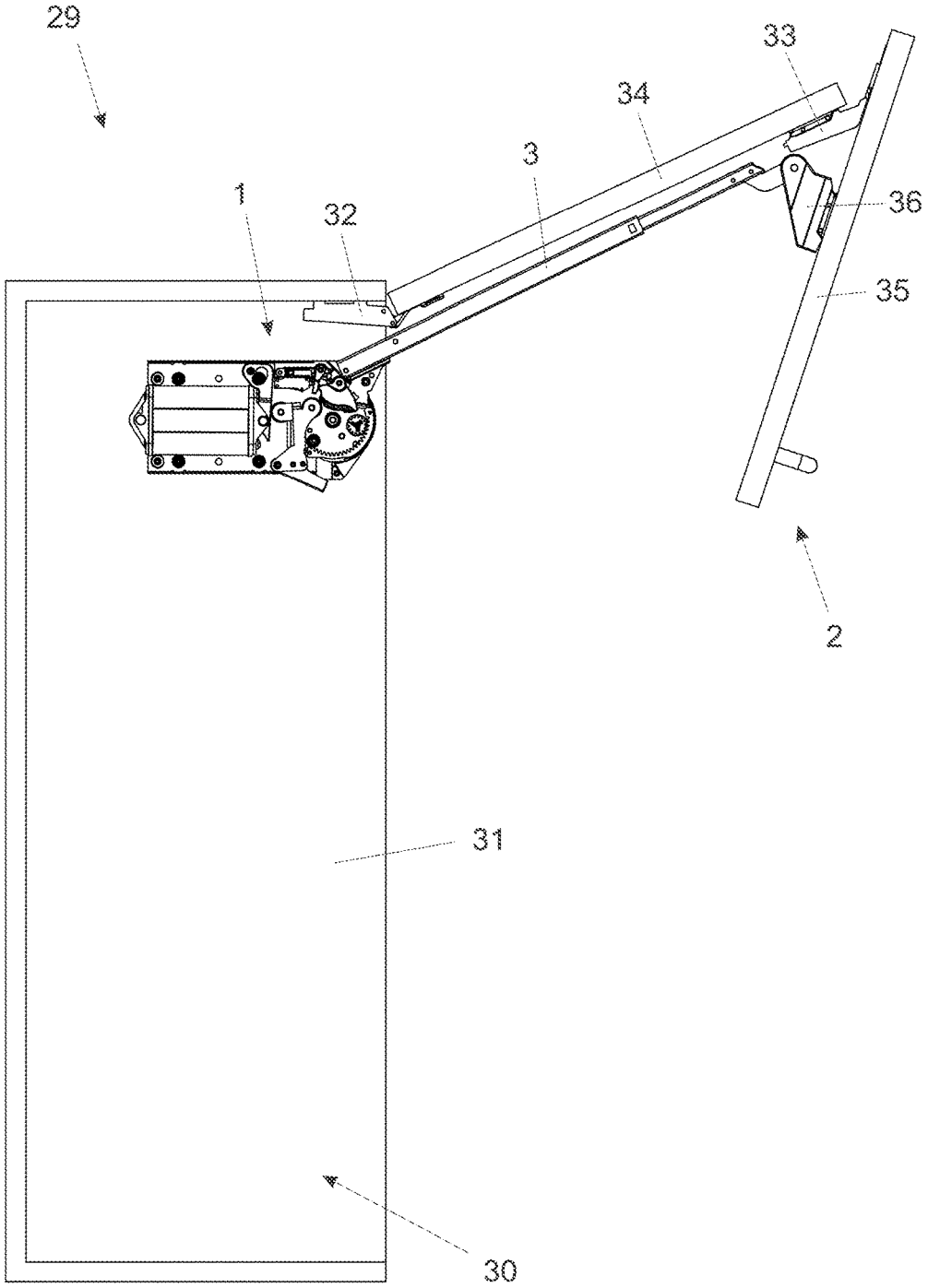
FIG. 1 shows furniture with a moveably mounted furniture part in the form of a folding flap and an actuating drive in a preferred embodiment.

FIG. 1 shows a lateral cross-sectional view of furniture 29 with a furniture body 30 and a furniture part 2 which is mounted in a moveable manner about a horizontal axis in the form of a flap, more precisely a folding flap consisting of two partial flaps 34 and 35. The furniture part 2 is connected to the furniture body 30 by at least one hinge 32, and the two partial flaps 34 and 35 are connected to one another in a swiveling manner by means of a central hinge 33.

The furniture 29 further comprises at least one actuating drive 1 which is arranged on a side wall 31 of the furniture body 30, and the actuating drive 1 has an actuating arm 3 which is connected to the furniture part 2 by a coupling part 36, more specifically the partial flap 35. The furniture 29 preferably comprises two actuating drives 1 of this type which are arranged on opposite sides 31 of the furniture body 30 and are each connected to the furniture part 2 by an actuating arm 3.

The moveable furniture part 2 has an open position which is shown in FIG. 1 and a closed position in which the moveable furniture part 2 covers an interior part of the furniture 29 in an outwards direction, at least in part. When the moveable furniture part 2 is in an open position, the actuating arm 3 of the actuating drive 1 is in an end position, hereinafter referred to as the second end position. When the moveable furniture part 2 is in a closed position, the actuating arm 3 is in a further end position, hereinafter referred to as the first end position.

In connection with FIG. 1, the moveable furniture part 2 shown in this figure carries out a swiveling movement 15 (see the sequence in FIGS. 7 to 9) upwards when the furniture 29 is in a use position and when there is a movement from the closed position into the open position.

Figure 2A:
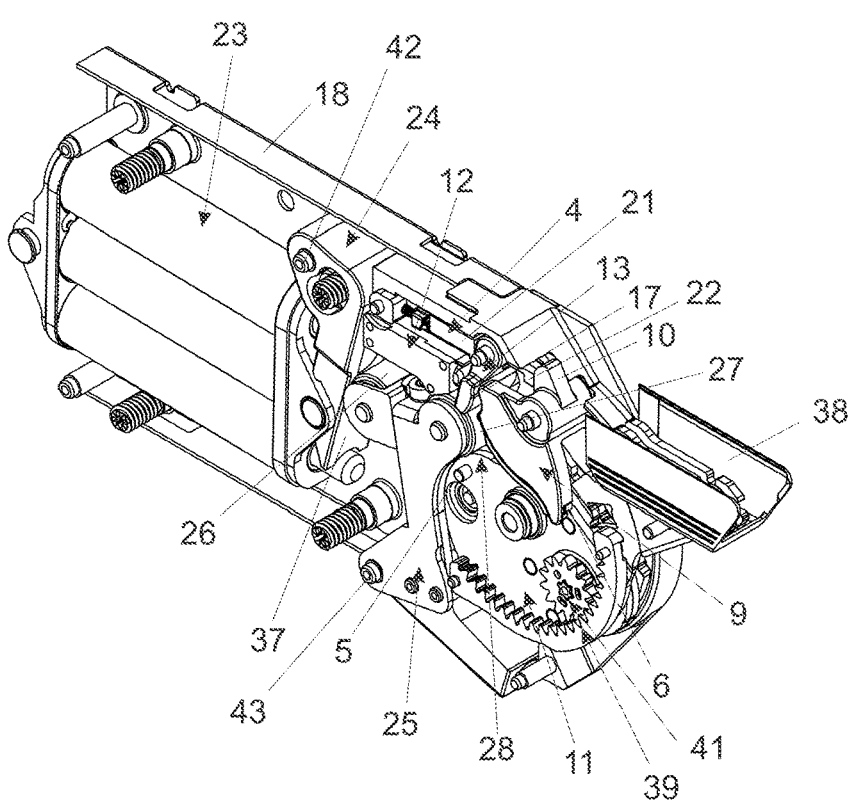
FIG. 2*a* is an enlarged, perspective view of the actuating drive with the housing partially open and without the actuating arm.
Figure 2B:
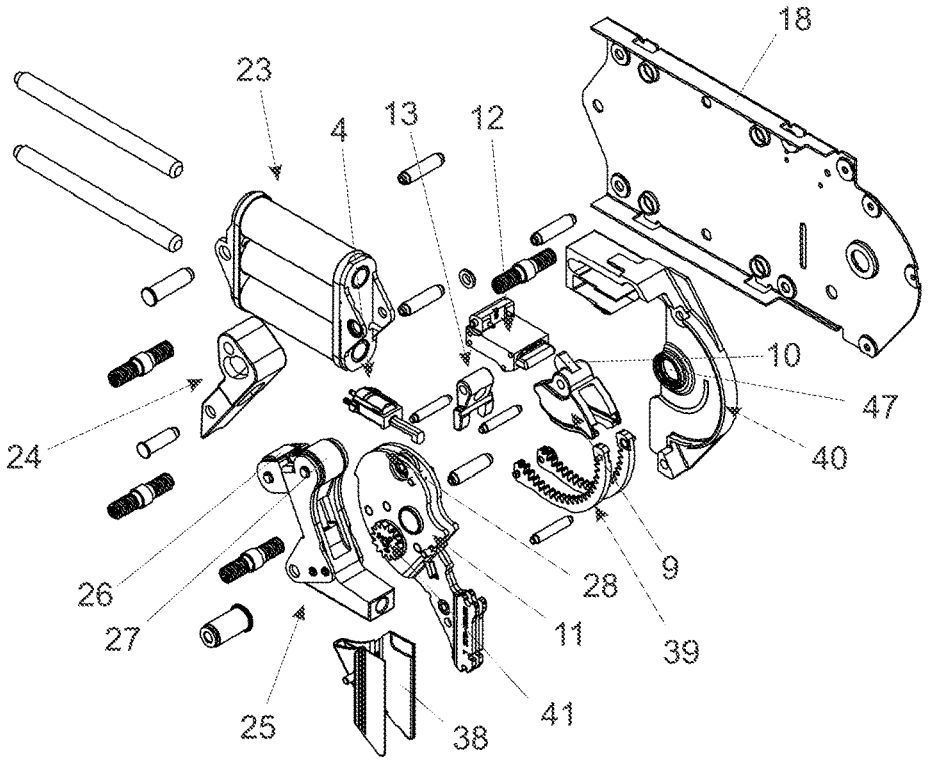
FIG. 2*b* is an exploded diagram of the actuating drive according to FIG. 2*a*.

As can be seen in FIGS. 2*a* and 2*b*, the actuating drive in a preferred embodiment comprises a housing 18. The two figures only show half of this housing to permit a view of the inside of the actuating drive. The actuating drive is covered by a second housing half which is a mirror image.

An assembly part 40 is rigidly connected to the housing 18, on which assembly part a linear damper 4 and an end position force store 12 are mounted. The assembly part 40 also forms a depository 47 for an actuating part 11, wherein the actuating part 11 is pivotably mounted against the assembly part 40 or the housing 18. Two sprockets 39 are also arranged on the housing 18 or the assembly part 40 in which a gearwheel 41 arranged on the actuating part 11 engages. In the event that the actuating part 11 is moved too rapidly against the housing 18, a braking element connected to the gearwheel 41 causes a braking of the movement of the actuating part 11 or the actuating arm 3 connected to this relative to the housing 18 to avoid injury to the user as a result of the actuating arm 3 moving too quickly. The actuating arm 3 can be connected to the actuating part 11 by an adapter piece 38.

The actuating drive 1 further has a coupling mechanism 5, 6, 9 and 10 to couple the at least one actuating arm 3 or the actuating part 11 which can be connected to the actuating arm to the linear damper 4 in the event of movements of the at least one actuating arm 3 into the two end positions. The coupling mechanism has an actuator 10 to carry out the damping stroke of the linear damper 4. The actuator 10 is arranged on a swiveling lever 9 in the embodiment shown. The swiveling lever 9 can be pivoted about a swiveling axis 45 relative to the housing 18 of the actuating drive 1. The coupling mechanism further comprises two control elements 5 and 6 which are implemented to be pin-shaped. The function of these is explained in greater detail below by the subsequent figures. The coupling mechanism further comprises a force transmission element 13 which can be pivoted about a swiveling axis 46 (see FIG. 3) relative to the housing 18. On the one hand, the force transmission element 13 has pressure acted on to it by the end position force store 12. On the other hand, the force transmission element 13 contacts the swiveling lever 9 by a contact means 17 arranged on the swiveling lever 9.

The linear damper 4 comprises a damper housing 21 and a plunger 22 which can be pushed in relative to the damper housing 21. The plunger 22 can be pushed in by the actuator 10 both in the event of the movement of the at least one actuating arm 3 into the first final position and in the event of the movement of the at least one actuating arm 3 into the second end position relative to the damper housing 21, as can be seen from the subsequent figures.

Finally, in the embodiment shown, the actuating drive 1 also comprises a main drive force store 23 to apply a force to the actuating arm 3 or the actuating part 11 which can be connected to the actuating arm, by a translation mechanism 24, 25, 26, 27, 28 and 37. The translation mechanism comprises a first intermediate lever 24 which can be pivoted about the swiveling axis 42 relative to the housing 18, which intermediate lever is flexibly connected to the main force store 23 and has a control contour 37. A first rolling element 26 of a second intermediate lever 25 rolls up on this control contour 37, which second intermediate lever is formed on the housing 18 and can be pivoted about the swiveling axis 43. The second intermediate lever 25 further has a second rolling element 27 which runs on a control contour 28 which is formed on the actuating part 11.

With reference to the end position force store 12 and the main force store 23, it is further noted that these preferably comprise at least one spring element, particularly preferably in the form of a compression spring.

Figure 3:
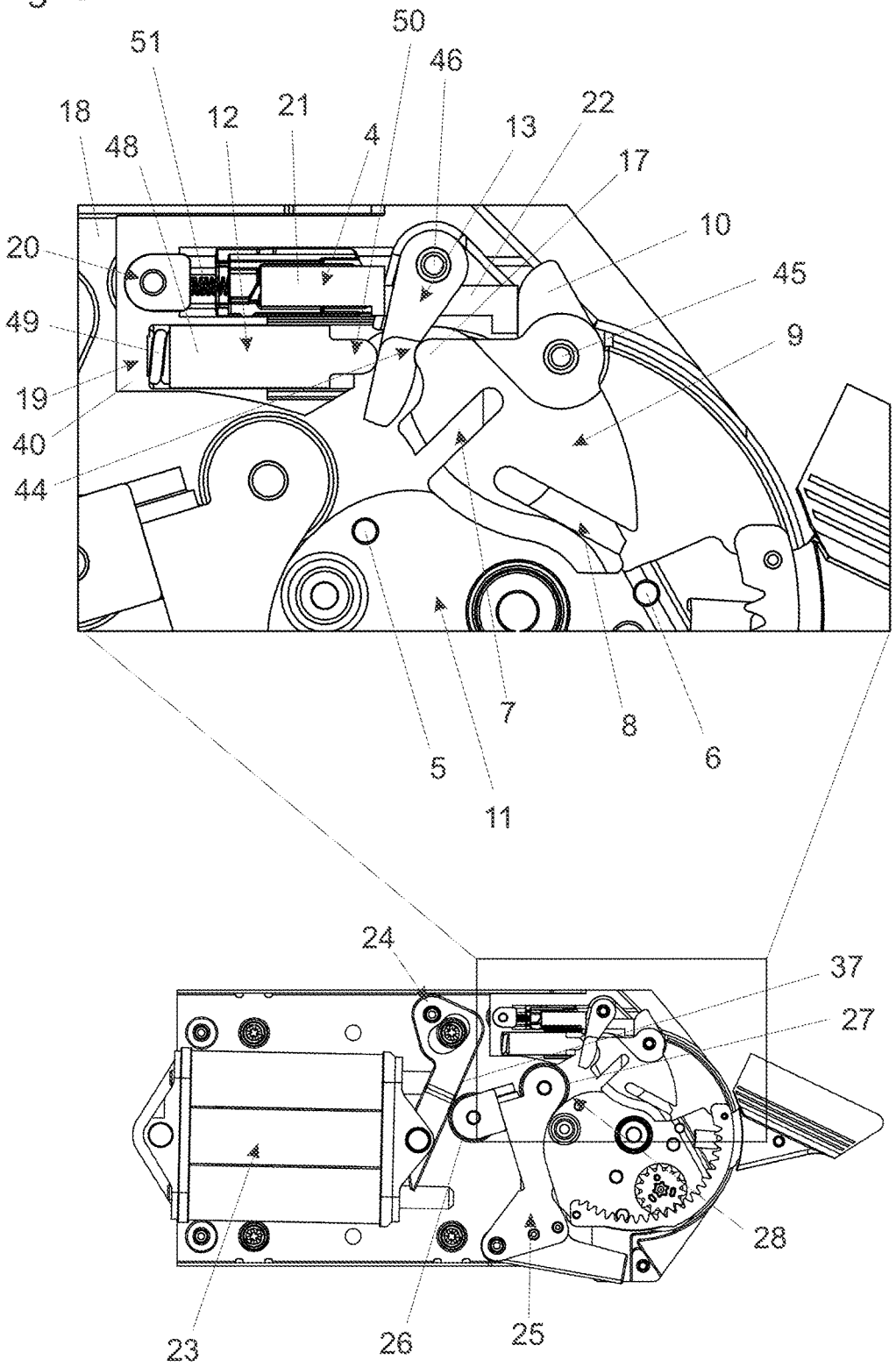
FIG. 3 shows a position of the actuating drive in which the actuating arm is in a central position between the two end positions.
Figure 4:
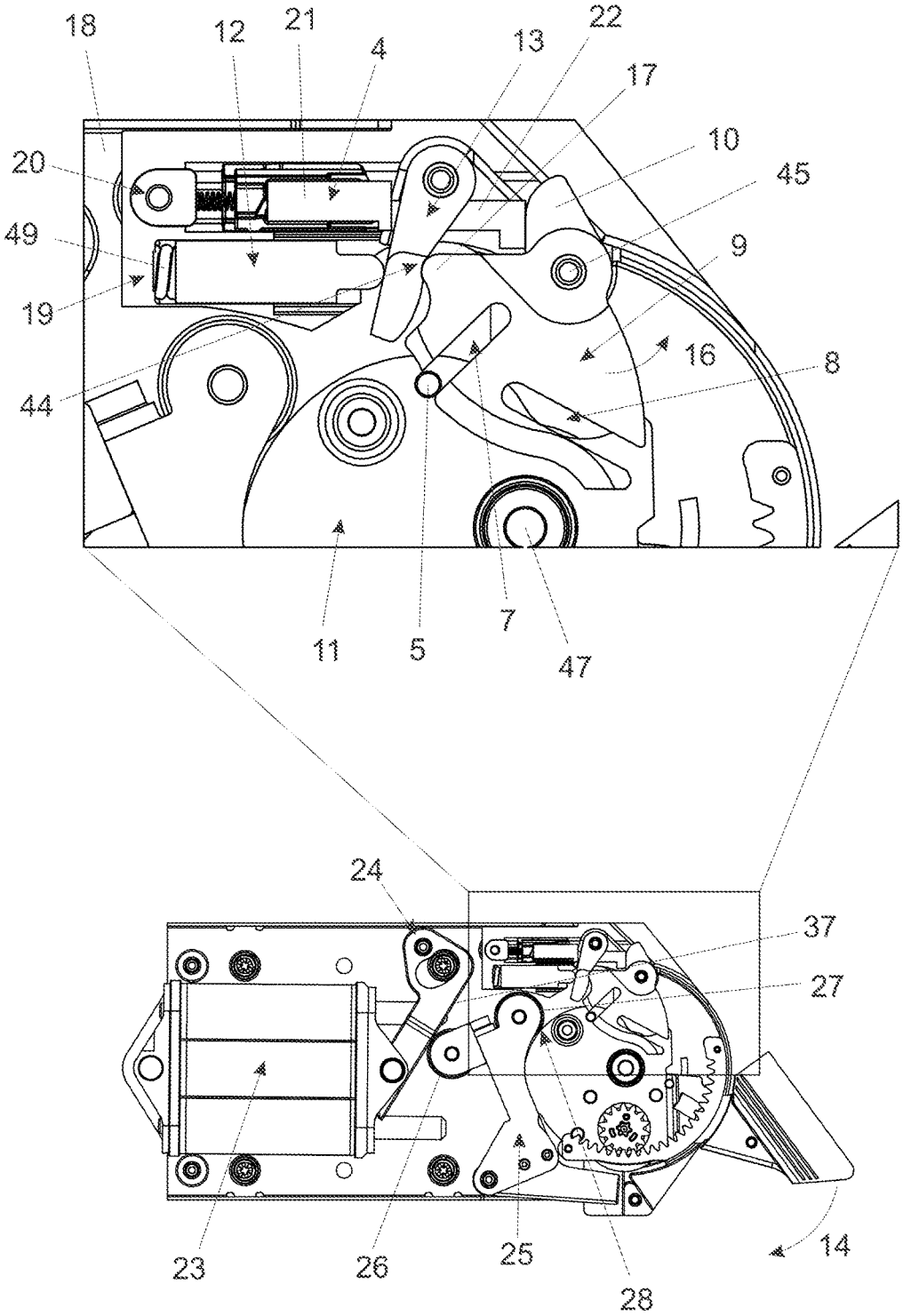
FIGS. 4-6 show a series of positions of the actuating drive to illustrate the movement of the at least one actuating arm into the first end position from a central position.
Figure 5:
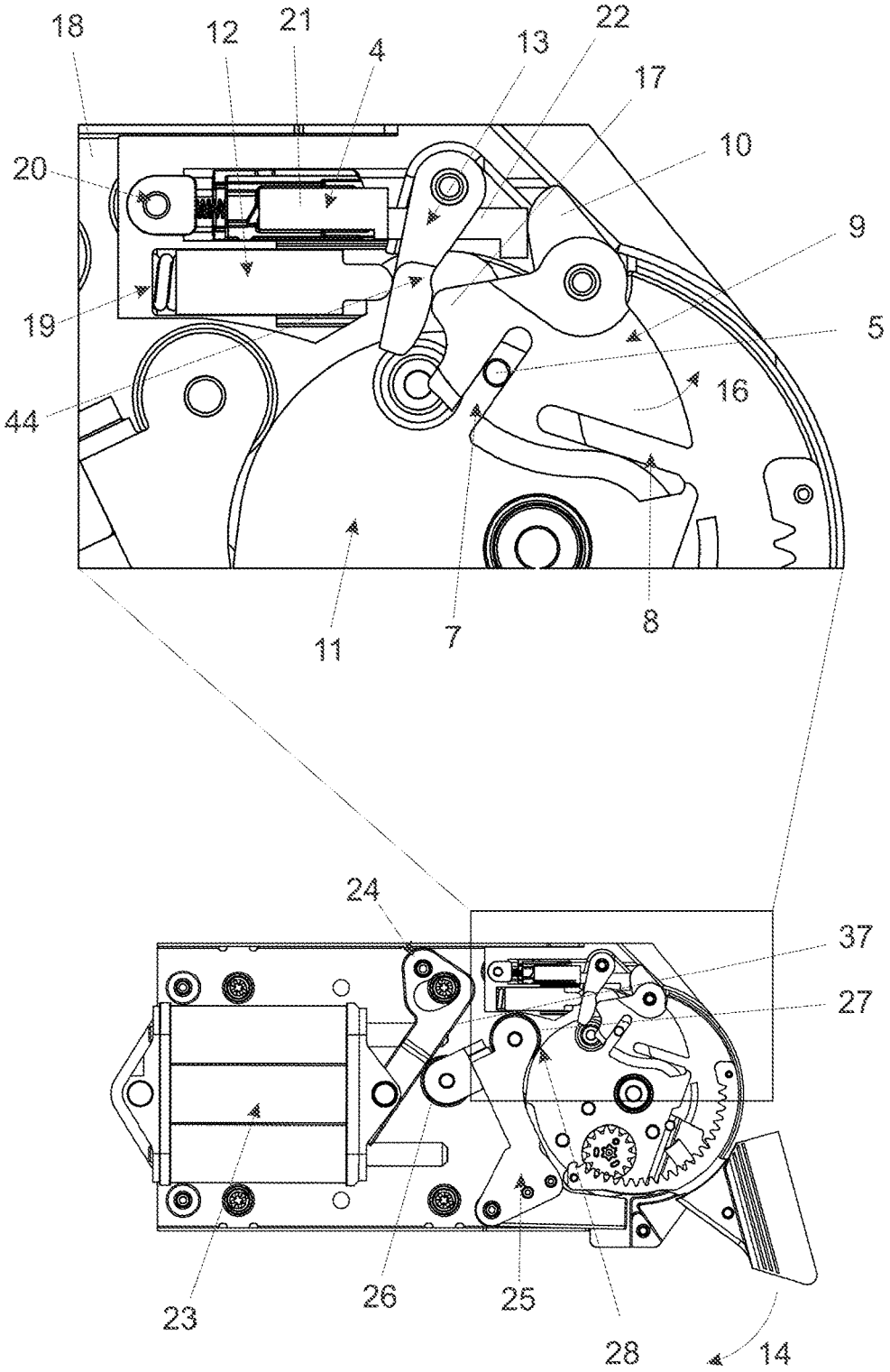
Figure 6:
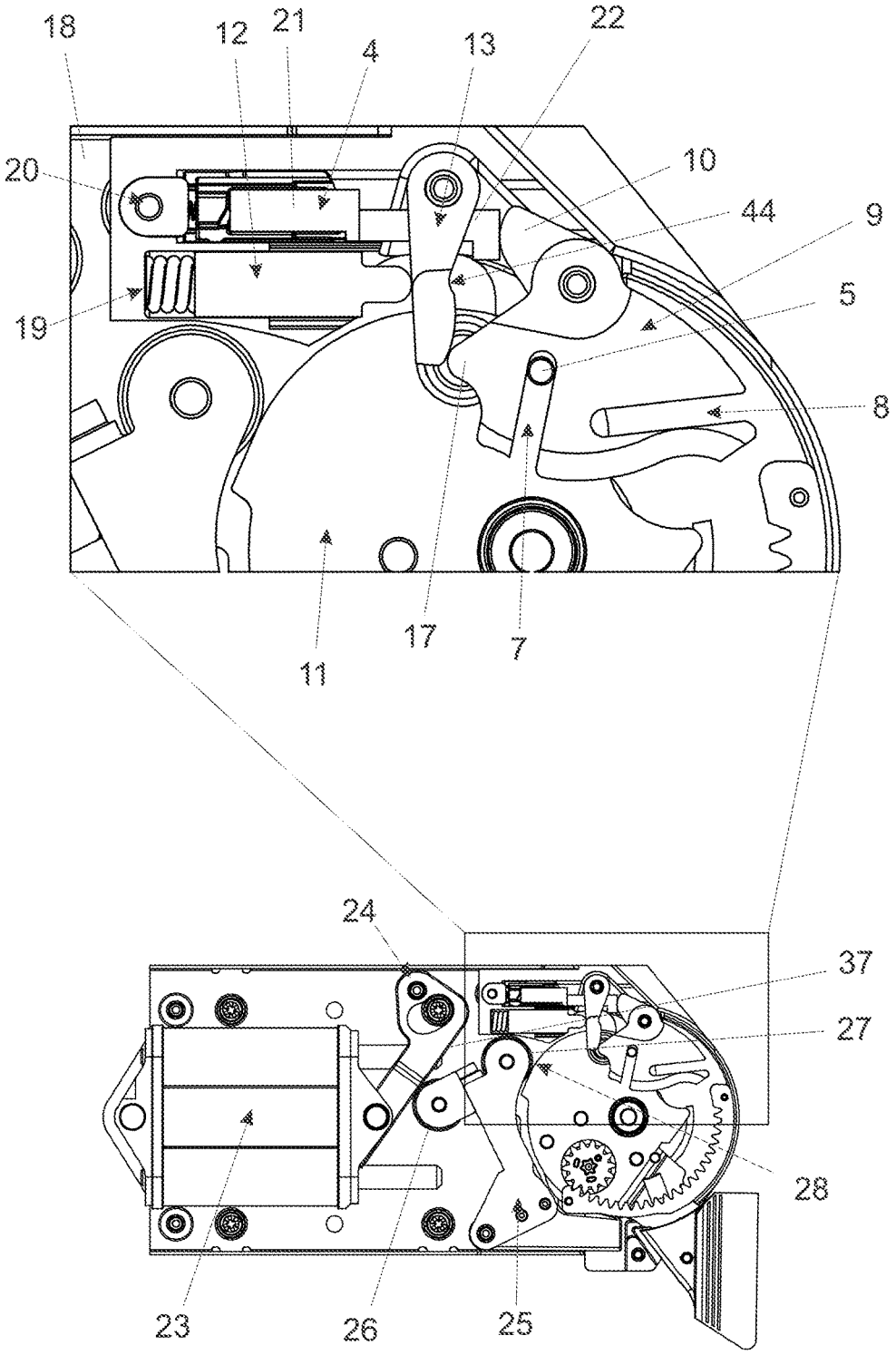

FIG. 3 shows the actuating drive 1 in a central position which approximately corresponds to an opening angle of 50°. In this figure, as for the subsequent figures, a relevant section of the actuating drive 1 is shown in an enlarged manner. In the central position according to FIG. 3 from which the actuating arm can on the one hand carry out a movement 14 into the first end position (see the sequence in FIGS. 4 to 6) and a movement 15 into the second end position (see the sequence in FIGS. 7 to 9), the end position force store 12 is essentially fully charged and in this condition is detachably locked by the force transmission element 13 and the swiveling lever 9, which engage in a force-locking manner in the force transmission element 13. A contact member 17 implemented as a projection is arranged on the swiveling lever 9 to generate the traction, and the contact member engages with a corresponding grooved hollow 44 which is arranged on the force transmission element 13.

The end position force store 12 comprises a sleeve 48 which is supported by a compression spring 49 which, on the one hand, engages with the sleeve 48 and, on the other hand, lies on the assembly element 40 or the housing 18. The end position force store 12 is therefore directly mounted on one end 19 of the housing 18. The opposite, free end 50 contacts the force transmission element 13.

The linear damper 4 is arranged essentially parallel to the end position force store 12, which linear damper is also mounted directly on an end 20 of the housing 18 by the assembly element 40. As mentioned, the linear damper 4 comprises a damper housing 21 and a plunger 22 that can be pushed in relative to the damper housing 21. The linear damper 4 further comprises a return spring 51 which moves the linear damper 4 back into the position according to FIG. 3 after a damping stroke. The linear damper 4 contacts the actuator 10 which is arranged on the swiveling lever 9 by the plunger 22.

In summary, the end position force store 12 in the rest position shown in FIG. 3 is fully charged and detachably locked. The linear damper 4 takes on a position with the plunger 22 essentially extended to the maximum degree and is ready for a damping stroke. There is no coupling between the linear damper 4 and the actuating arm 3 or the actuating part 11 that can be connected to the actuating arm in this rest position.

If the actuating arm 3 now carries out a movement 14 into the first end position which corresponds to the closed position of the moveably mounted furniture part 2, the following processes occur in the actuating drive 1 (see FIGS. 4 to 7):

The actuating part 11 which can be connected to the actuating arm 3 is pivoted until the control element 5 arranged on the actuating part 11 and connected to the at least one actuating arm 3 for movement comes into contact with the first control curve 7, which is arranged on the swiveling lever 9, for the first time. The relative arrangement of the rotary axes 47 of the actuating part 11 and 45 of the swiveling lever 9 and the relative arrangement of the control element 5 and the control curve 7 means in a subsequent further swivel movement 14 of the actuating arm 3 in the direction of the first end position of the actuating arm, the swiveling lever 9 is converted to a swivel movement 16 that is opposite to the swivel movement 14. Specifically, the actuating part 11 moves in a clockwise direction and the swiveling lever 9 in a counter-clockwise direction.

As a result of this rotational movement, which is forced by the control element 5 engaging in the control curve 7, the contact member 17 moves out of the grooved hollow 44 of the force transmission element 13. As a further result, the compressed spring 49 of the end position force store 12 can loosen. The force released in this process is transferred to the swiveling lever 9 by the force transmission element 13, which subsequently actively drives the actuating arm 3, in turn by the engagement of the control element 5 in the control curve 7.

At the same time, together with the swiveling lever 9, the actuator 10 arranged on it is pivoted in a counter-clockwise direction and therefore pushed against the plunger 22 of the linear damper 4. As a result, the plunger 22 is pushed in relative to the damper housing 21, resulting in the linear damper 4 deploying its damping effect. In other words, the actuator 10 carries out the damping stroke of the linear damper 4.

In summary, the special arrangement of an end position force store 12 and linear damper 4 results in the actuating arm 3 which can be connected to the actuating part 11 being moved into the first end position in an actively damped manner.

Figure 7:
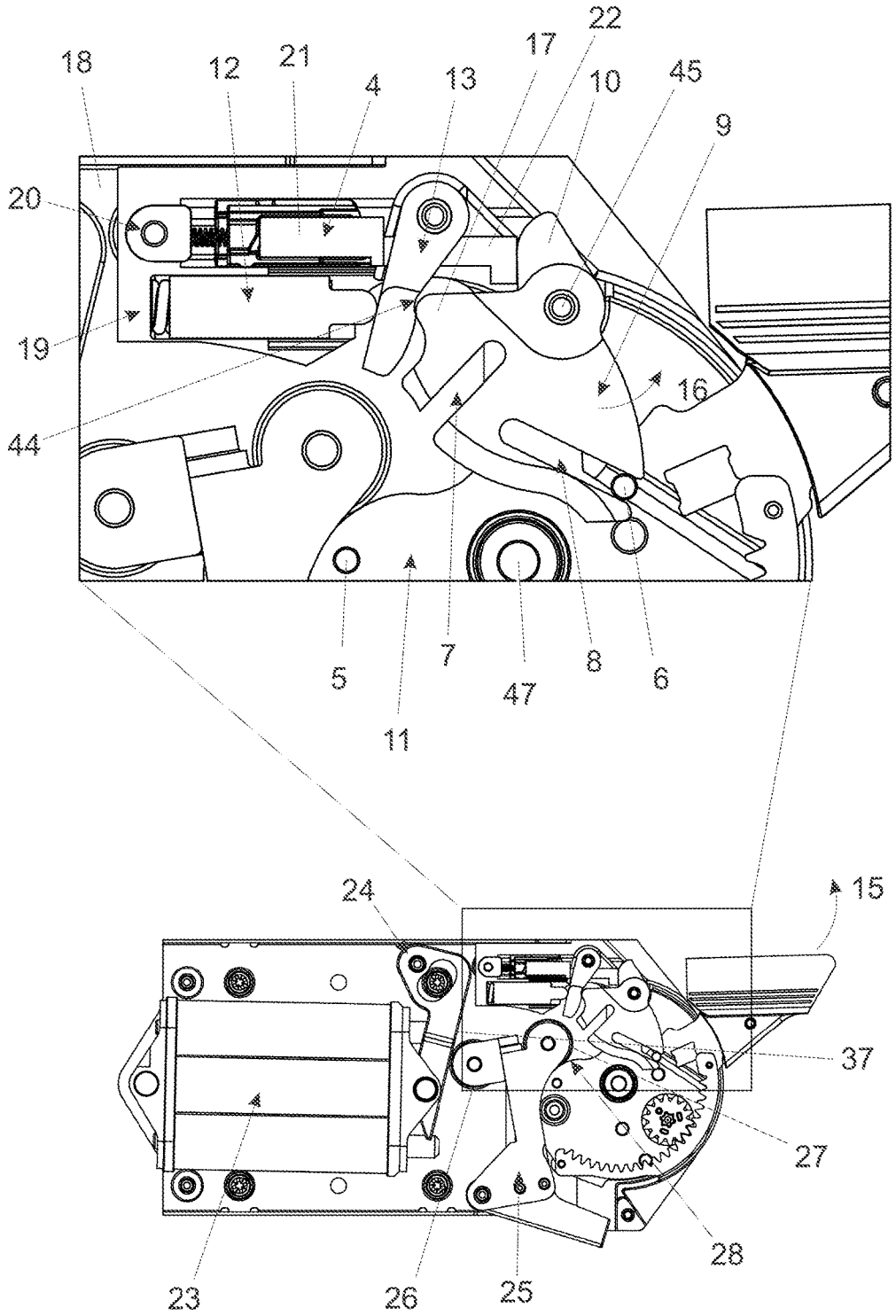
FIGS. 7-9 show a series of positions of the actuating drive to illustrate the movement of the at least one actuating arm into the second end position from a central position.
Figure 8:
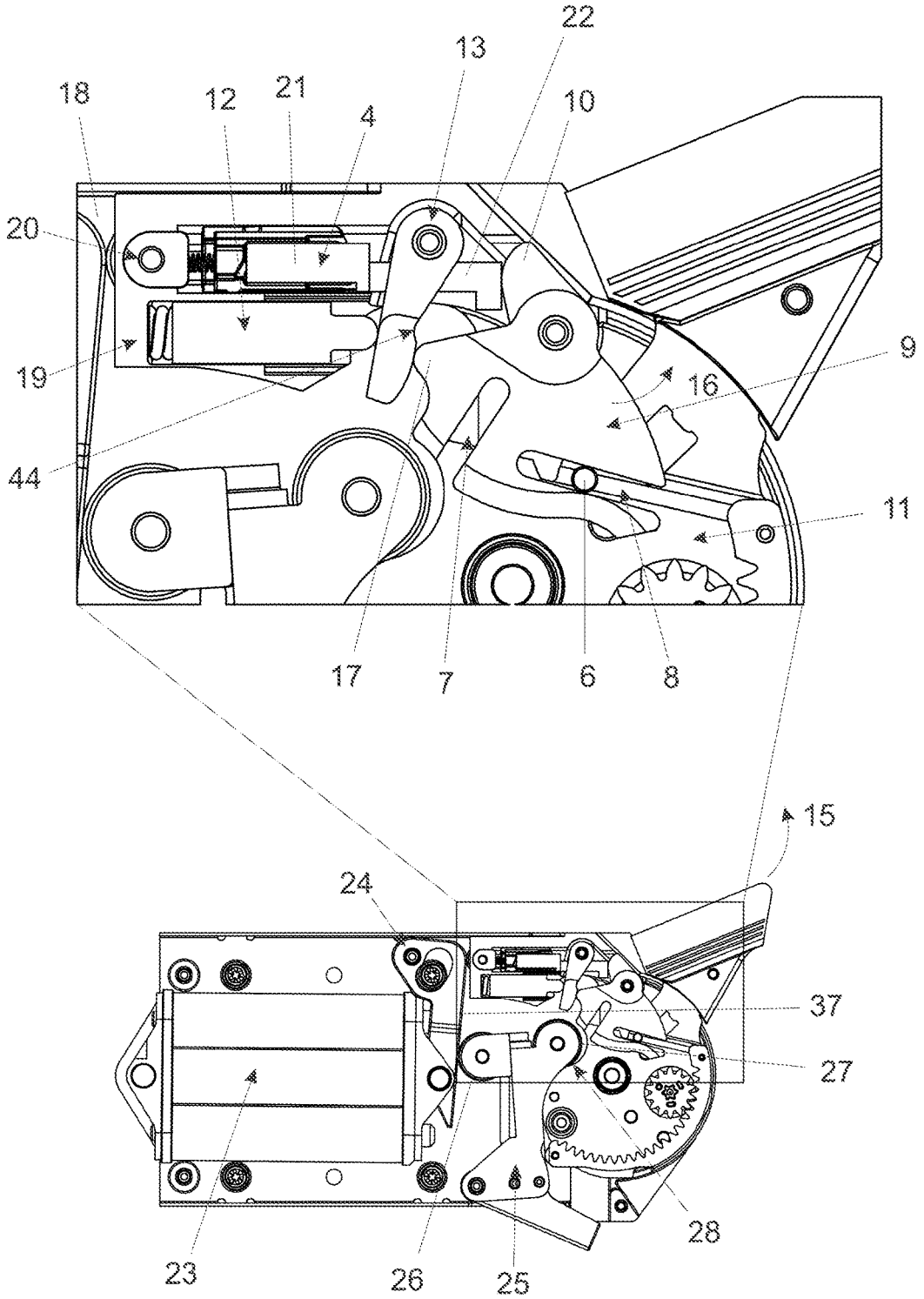
Figure 9:
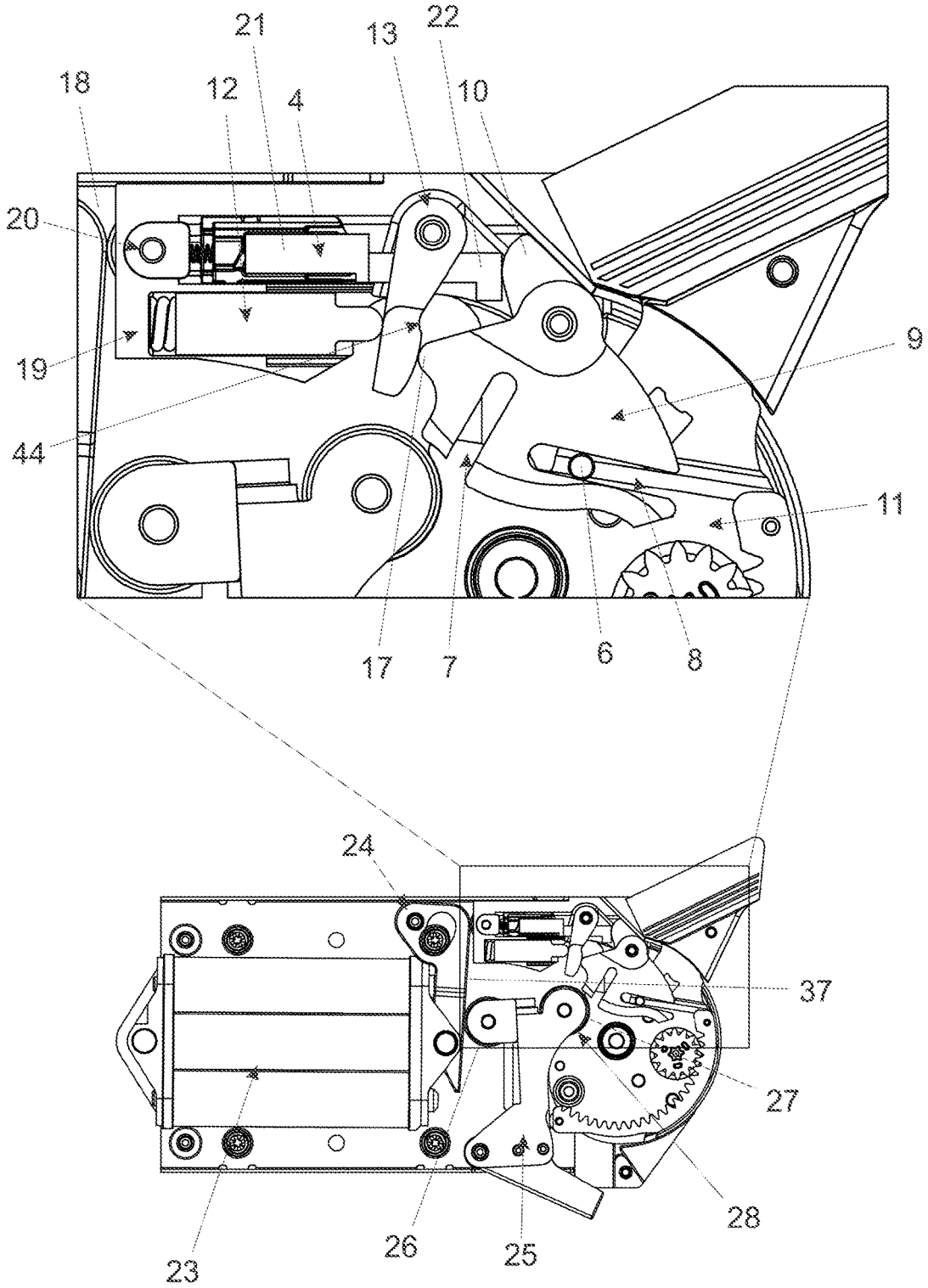

The sequence of FIGS. 7 to 9 shows the movement of the actuating arm 3 starting from the central position according to FIG. 3 into the second end position, which corresponds to the open position of the moveable furniture part. In this movement 15, which is carried out in a counter-clockwise direction, the second control element 6 contacts the second control curve 8 resulting in a coupling of the at least one actuating arm 3 or the actuating part 11 which can be connected to the actuating arm. As a result of this engagement of the pin-shaped control element 6 in the second control curve 8 and the relative arrangement of the rotary axes 45 and 47 and the relative arrangement of the second control curve 8 relative to the second control element 6, the swiveling lever 9 then also carries out a swiveling movement 16 in a counter-clockwise direction. The end position force store 12 and the linear damper 4 then deploy the same effects as for a movement of the at least one actuating arm 3 into the first end position.

If the process which occurs in the actuating drive 1 in the event of a movement of the actuating arm 3 into the first end position is compared with the process which occurs in the event of a movement of the at least one actuating arm 3 into the second end position, it can be determined that the two control elements 5 and 6 and the two control curves 7 and 8 which interact with these act as a rectification mechanism to convert the two swiveling movements 14 and 15 of the at least one actuating arm 3 into a swiveling movement 16 of the swiveling lever 9 in the same direction in each case.

The invention claimed is:

1. An actuating drive for driving a movably mounted furniture part, the actuating drive comprising:

an actuating arm to be connected to the furniture part, the actuating arm being formed to be moveable between a first end position and a second end position, a damper for damping both a movement of the actuating arm into the first end position and a movement of the actuating arm into the second end position, the damper being configured to carry out a damping stroke, and a coupling mechanism for coupling the actuating arm or an actuating part connected to the actuating arm to the damper at least in the case of the movements of the actuating arm into the two end positions, the coupling mechanism including an actuator for carrying out the damping stroke of the damper, a main drive force store to apply a force to the actuating arm or an actuating part connected to the actuating arm, and an end position force store for applying a force to the actuating arm when the actuating arm moves into the first end position and when the actuating arm moves into the second end position, wherein the actuator is configured to act on the damper both in the movement of the actuating arm into the first end position and in the movement of the actuating arm into the second end position to carry out the damping stroke, wherein the actuating arm is configured to carry out a first swivel movement when moving into the first end position and a second swivel movement when moving into the second end position, the second swivel movement being opposite to the first swivel movement, wherein the coupling mechanism further includes:

a swiveling lever and a rectification mechanism for converting the first swivel movement and the second swivel movements of the actuating arm into a swivel movement of the swiveling lever carried out in the same direction, and a force transmission element, the end position force store being configured to act on the force transmission element both when the actuating arm moves into the first end position and when the actuating arm moves into the second end position, and wherein the end position force store is releasably lockable by the force transmission element and the swiveling lever which is movable relative to the force transmission element and which is engagable with the force transmission element in a force-locking or form-locking manner when the end position force store is charged.

2. The actuating drive according to claim 1, wherein the end position force store is chargeable when the actuating arm moves from the first end position and when the actuating arm moves from the second end position.

3. The actuating drive according to claim 1, wherein the damper and the end position force store are arranged essentially in parallel to one another.

4. The actuating drive according to claim 1, wherein the actuator is rotatable.

5. The actuating drive according to claim 1, wherein the actuator is arranged on the swiveling lever, and/or a contact part for contacting the force transmission element is arranged on the swiveling lever.

6. The actuating drive according to claim 1, wherein the actuating drive comprises a housing, the damper and/or the end position force store on an end is mounted on the housing.

7. The actuating drive according to claim 6, wherein the end position force store is fixed on the housing.

8. The actuating drive according to claim 1, wherein the damper is a linear damper.

9. The actuating drive according to claim 8, wherein the linear damper has a cylinder and a piston movable relative to the cylinder, the linear damper is configured to be acted on by the actuator in the event of a movement of the actuating arm into the first end position and in the event of the movement of the actuating arm into the second end position such that only the piston moves and the cylinder is immobile or the cylinder moves and the piston is immobile, and the piston or the cylinder moves in the same direction during both movements of the actuating arm.

10. The actuating drive according to claim 8, wherein the linear damper has a damper housing and a plunger configured to be pushed in relative to the damper housing, the linear damper configured to be acted on by the actuator both during the movement of the actuating arm into the first end position and during the movement of the actuating arm into the second end position such that only the plunger moves and the damper housing is immobile or only the damper housing moves and the plunger is immobile, and the plunger or the damper housing moves in the same direction during both movements of the actuating arm.

11. The actuating drive according to claim 1, wherein the main drive force store is configured to apply the force to the actuating arm or an actuating part connected to the actuating arm by a transmission mechanism.

12. A piece of furniture comprising:

a furniture body;

a furniture part mounted in a moveable manner; and the actuating drive according to claim 1 arranged on the furniture body, wherein the actuating arm is connected to the furniture part.

13. The piece of furniture according to claim 12, wherein the furniture part is a flap mounted about a horizontal axis.

14. The piece of furniture according to claim 12, wherein the furniture part is connected to the furniture body by a hinge.

15. The piece of furniture according to claim 14, wherein the furniture part is a folding flap comprising a first partial flap and a second partial flap, the first partial flap being pivotably mounted on the furniture body and the second partial flap being pivotably connected to the first partial flap by a central hinge, and the actuating arm of the actuating drive being connected to the second partial flap.

16. The piece of furniture according to claim 12, wherein the furniture part has an open position and a closed position, and the closed position of the furniture part corresponds to the first end position of the actuating arm and the open position of the furniture part corresponds to the second end position of the actuating arm.

17. The piece of furniture according to claim 16, wherein the furniture part is configured to carry out a swiveling movement in an upwards direction during a movement from the closed position to the open position.

18. An actuating drive for driving a movably mounted furniture part, the actuating drive comprising:

an actuating arm to be connected to the furniture part, the at least one actuating arm being formed to be moveable between a first end position and a second end position, a damper for damping both a movement of the actuating arm into the first end position and a movement of the actuating arm into the second end position, the damper being configured to carry out a damping stroke, and a coupling mechanism for coupling the actuating arm or an actuating part connected to the actuating arm to the damper at least in the case of the movements of the actuating arm into the two end positions, the coupling mechanism including an actuator for carrying out the damping stroke of the damper, and a main drive force store to apply a force to the actuating arm or an actuating part connected to the actuating arm, wherein the actuator is configured to act on the damper both in the movement of the actuating arm into the first end position and in the movement of the actuating arm into the second end position to carry out the damping stroke, wherein the actuating arm is configured to carry out a first swivel movement when moving into the first end position and a second swivel movement when moving into the second end position, the second swivel movement being opposite to the first swivel movement, wherein the coupling mechanism further includes a swiveling lever and a rectification mechanism for converting the first swivel movement and the second swivel movement of the actuating arm into a swivel movement of the swiveling lever carried out in the same direction, wherein the rectification mechanism has a first control curve and a second control curve and a first control element and a second control element, wherein the first control element and the second control element being coupled to the actuating arm in terms of movement, the first control element in the first end position of the actuating arm engages with the first control curve and the second control element in the second end position of the actuating arm engages with the second control curve.

19. The actuating drive according to claim 18, wherein (i) the first control curve and the second control curve run in a linear manner and/or (ii) the first control curve and the second control curve are aligned in an essentially rectangular manner relative to one another and/or (iii) the first control element and the second control element are pin-shaped.

20. The actuating drive according to claim 18, wherein (i) the first control curve and the second control curve are arranged on the swiveling lever and/or (ii) the first control element and the second control element are arranged on an actuating part connected to the actuating arm.

* * * * *